United States Patent [19]

Melde-Tuczai et al.

[11] Patent Number: 4,732,119

[45] Date of Patent: Mar. 22, 1988

[54] INTERNAL COMBUSTION ENGINE

[75] Inventors: Helmut Melde-Tuczai; Skatsche Othmar; Mario Sucher, all of Graz, Austria

[73] Assignee: AVL Gesellschaft für Verbrennungskraftmaschinen und Messtechnik m.b.H. Prof.Dr.Dr.h.c. Hans List, Graz, Austria

[21] Appl. No.: 864,205

[22] Filed: May 19, 1986

[30] Foreign Application Priority Data

May 22, 1985 [AT] Austria ..... 1548/85

[51] Int. Cl.[4] ..... F01L 1/26

[52] U.S. Cl. ..... 123/90.4; 123/90.23; 123/90.27

[58] Field of Search ..... 123/90.27, 90.23, 90.22, 123/90.4, 90.5, 90.44

[56] References Cited

U.S. PATENT DOCUMENTS

| | | | |
|---|---|---|---|
| 1,415,167 | 5/1922 | Fuchs | 123/90.27 |
| 3,139,870 | 7/1964 | Sampietro | 123/90.4 |
| 4,327,678 | 5/1982 | Pollet | 123/90.4 |
| 4,527,518 | 7/1985 | Osaki | 123/90.23 |
| 4,561,391 | 12/1985 | Simko | 123/90.4 |

*Primary Examiner*—Ronald B. Cox

*Attorney, Agent, or Firm*—Watson, Cole, Grindle & Watson

[57] ABSTRACT

Two or more valves which are positioned opposite one another relative to a center plane in which the cylinder axis and the crankshaft axis are located and which are arranged in the cylinder head in a parallel, upright position, are actuated via separate cams and levers by a camshaft which is spaced from the center plane and extends in parallel with the crankshaft. The lever actuating the valve on the same side of the center plane as the camshaft is configured as a one-armed lever which is positioned underneath the camshaft and is supported by a bearing on the cylinder head. The lever actuating the valve on the other side of the center plane is configured as a rocker lever, its axle being situated above the one-armed lever, parallel to the camshaft. The compact and rigid design of the valve gear achieved in this manner is particularly well suited for four-valve arrangements, permitting the one-armed levers together with the corresponding cams to be positioned between the rocker levers and their cams (relative to a cross-plane of each cylinder).

3 Claims, 4 Drawing Figures

Fig.3
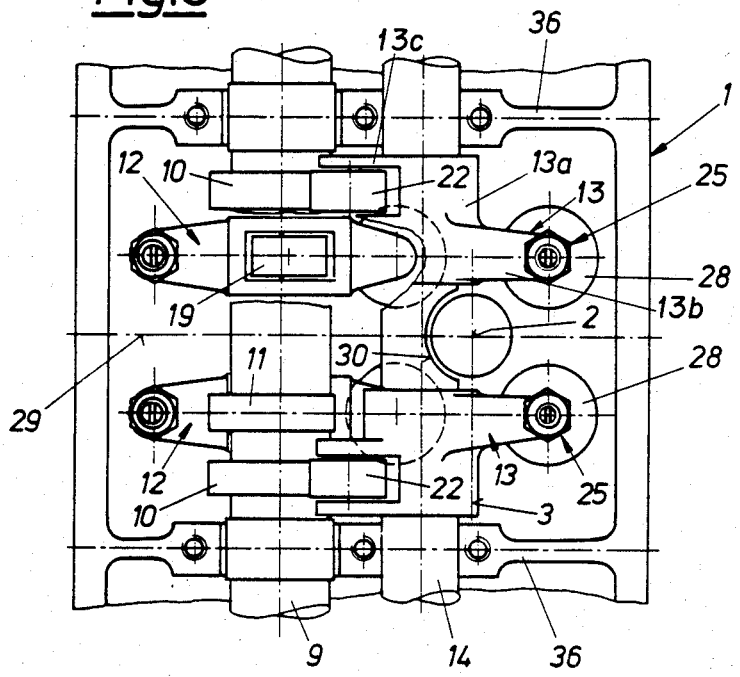
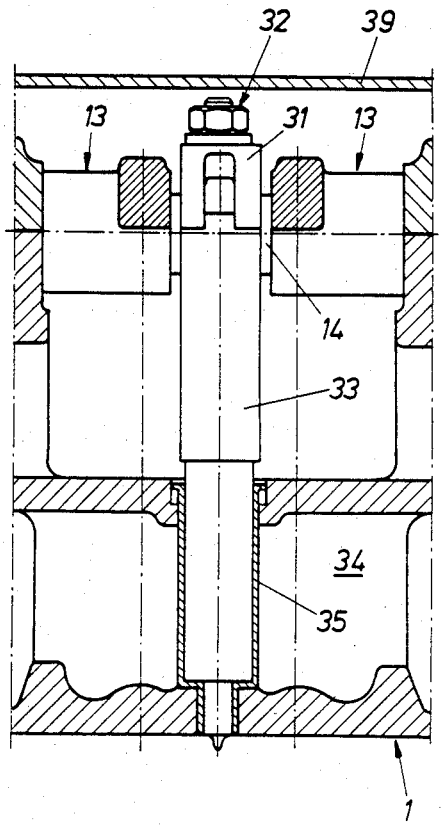
Fig.4

INTERNAL COMBUSTION ENGINE

BACKGROUND OF THE INVENTION

The invention relates to an internal combustion engine with one or more cylinders, comprising a crankshaft and a camshaft parallel to the crankshaft, further comprising a cylinder head, each of the cylinders containing two or more valves, i.e., an intake and an exhaust valve, which are arranged in the cylinder head in approximately parallel position and are opposite each other relative to a center plane including all axes of the cylinders and the crankshaft, the valves being actuated by the camshaft located off the center plane in the area of the cylinder head via cams and actuating levers, one of which is configured as rocker lever and the other one as a one-armed lever.

DESCRIPTION OF THE PRIOR ART

An internal combustion engine of the above type is described in GB-PS No. 960 396. In this engine, intake and exhaust valves are situated in the cylinder on either side of the center plane, opposite valves being actuated by one common cam. This arrangement does not permit the selection of an ideal cam shape nor the optimum timing of intake and exhaust. It necessitates compromises for geometrical reasons which cannot be tolerated in modern high-performance engines.

In another known design, two banks of cylinders are placed in a V-shaped arrangement, the camshaft being situated above the intake ports at the level of the upper end of the water jacket of the cylinder head, beside the intake valves. The valves are actuated by rocker levers of different lengths whose rocker axle is situated above the camshaft; these levers must be of considerable length—at least for actuation of the valves situated on the far side of the camshaft—which will cause problems with regard to undesired elastic deformations of the valve gear and the overall weight and exterior dimensions of the engine.

SUMMARY OF THE INVENTION

It is an object of the present invention to improve an internal combustion engine of the aforementioned type such that the above disadvantages are avoided and that a space- and weight-saving design is achieved which permits the timing of intake and exhaust valves to be adjusted as desired, in addition to making individual components of the valve gear and the injection nozzle easily accessible.

According to the invention this is achieved by providing the camshaft with two cams at an axial distance for actuation of each pair of opposing valves, and by providing cranked rocker levers. Due to these properties, control times and cam shapes may be adjusted to ideally suit the respective requirements while consuming a minimum of space. Thus, each valve on the side of the camshaft is actuated by a one-armed lever whose end away from the valve to be actuated is supported by a bearing on the outside of the cylinder head, and which—between this bearing and the valve to be actuated—is operated by the camshaft situated above it, or rather the corresponding cam. Each of the valves on the other side of the center plane including the cylinder axis and the crankshaft axis is actuated via a two-armed, cranked rocker lever whose axle is situated above the one-armed lever, which permits a very compact design of the valve gear without restricting the freedom of movement of its individual components. In addition to the reduction in space and weight, the valve mechanism is characterized by great rigidity because of the shortness of the lever arms. Besides, the space-saving design will permit the critical components to be dimensioned such as to ensure reliability and a long working life.

The rocker lever may also be designed to cooperate with the respective cam above a plane normal to the cylinder axis and including the camshaft axis, which will result in a simple configuration of the rocker lever while ensuring that the individual components of the valve gear do not impede one another.

In a preferred variant of the invention, the rocker axle is situated at the same height above the bottom of the cylinder head as the camshaft, which will further reduce the overall height of the valve gear and improve the position of the camshaft and axle bearings with regard to production and assembly.

In another preferred variant of a combustion engine according to the invention, comprising four valves in tandem arrangement opposite each other relative to the center plane, the cams actuating the valves on the side of the camshaft are placed between the cams actuating the valves on the other side. If required by the particular arrangement of the individual cams or valve axes, the rocker levers and/or the one-armed levers between them may be configured such that they form an acute angle with the axis of the camshaft or the lever axle, which will cause no problems in view of the fact that the rocker axles are positioned above the one-armed levers.

DESCRIPTION OF THE DRAWINGS

Following is a more detailed description of the invention as illustrated by the accompanying drawings in which

FIG. 3 presents a view along arrow III in FIG. 1, with the cover of the valve housing removed;

FIG. 4 presents a section along line IV—IV in FIG. 1, including the injection nozzle which is not shown in FIGS. 1 to 3.

DETAILED DESCRIPTION OF THE PREFERRED EMBODIMENT

Figure 1:
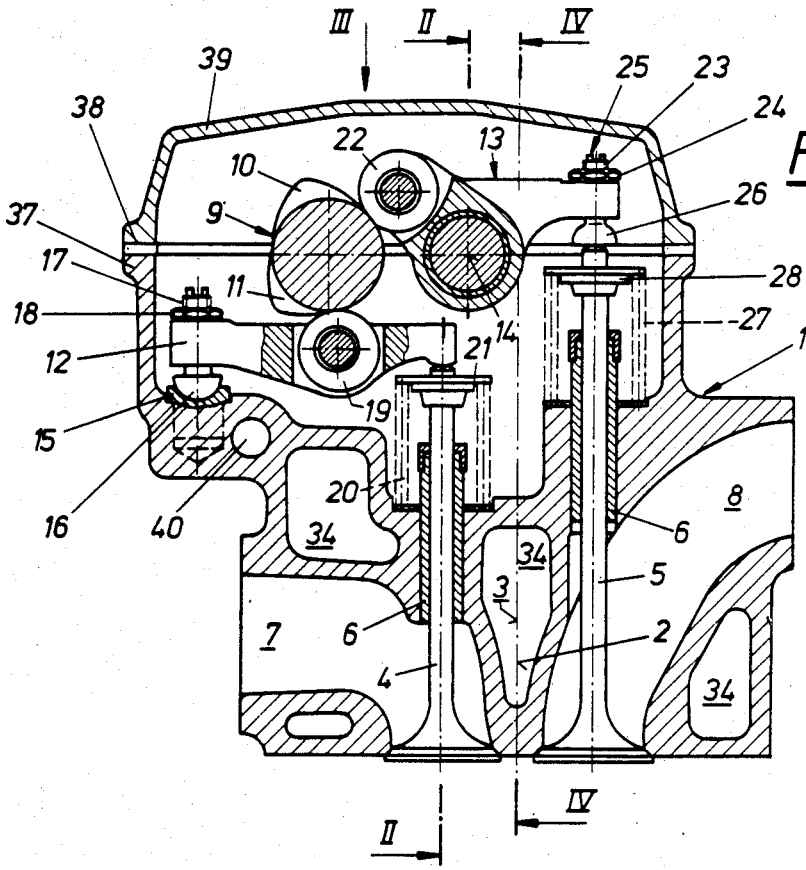
FIG. 1 presents a section of the cylinder head of an internal combustion engine as specified by the invention, in a cross-plane normal to the longitudinal center plane and including the cylinder axis.
Figure 2:
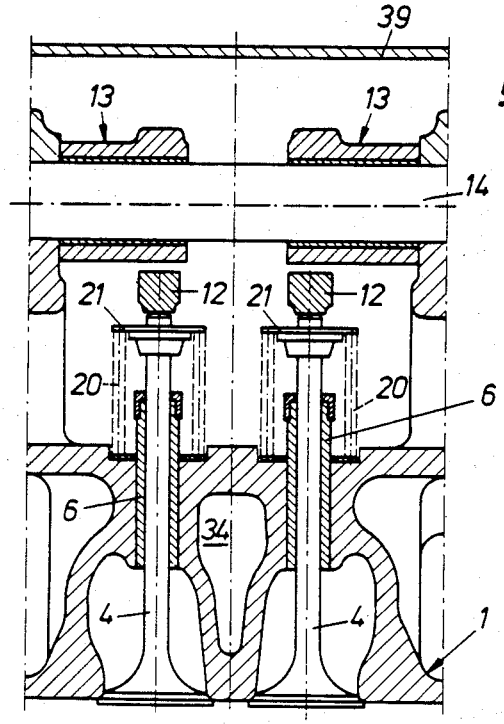
FIG. 2 presents a section along line II—II in FIG. 1.

Each cylinder of the multi-cylinder internal combustion engine, presented here by its cylinder head 1 only, has four valves 4, 5 arranged in pairs on either side of a center plane in which the cylinder axis 2 and the crankshaft axis (not shown) is located , the valves being arranged in the cylinder head 1 in upright position, approximately parallel to each other and to the cylinder axis 2, and move in suitable guiding sleeves 6. The two exhaust valves closing the correponding exhaust ports 7 have the number 4, and the two intake valves closing the corresponding intake ports 8 have the number 5.

All four valves of each cylinder are actuated via separate cams 10, 11 and levers by a camshaft 9 which is located in the cylinder head 1 spaced from the center plane 3 parallel to the crankshaft (not shown in this drawing). The levers actuating the exhaust valves 4 on the side of the camshaft are positioned directly beneath the camshaft 9 and are configured as one-armed levers 12. The levers actuating the intake valves 5 on the other side (relative to the center plane 3) are configured as cranked rocker levers 13 whose axle 14 is situated above the one-armed levers 12, parallel to the camshaft 9.

The end of each one-armed lever 12 facing away from the exhaust valve 4 to be actuated is supported by a bearing on the cylinder head 1, adjustments in height relative to the bearing pan 15 being possible by means of a ball pin 16 with a thread 17 and a counter nut 18. Contact with the corresponding cam 11 is established by a roller 19 situated approximately halfway between the two ends of the one-armed lever 12, which will reduce friction losses in the valve gear, and is pressed against the cam 11 by the valve spring 20 acting upon a valve disk 21 during operation of the assembly.

The rocker lever 13, whose axle 14 is at the same level above the bottom of the cylinder head as the camshaft 9 in this variant, is cranked, the roller 22 cooperating with the respective cam 10 being situated above a plane normal to the cylinder axis 2 and including the axis of the camshaft 9. At the end of the two-armed rocker lever 13 facing away from the roller 22, or rather the point of contact with the camshaft 9, an actuating element 25 is provided whose height is adjustable by means of a thread 23 and a counter-nut 24, which element will act via a pan 26 upon the stems of the intake valves 5, which are longer than those of the exhaust valves 4. Contact between the actuating element 25 and the stem of the valve 5 is established by the valve spring 27, or rather the valve disk 28, during operation of the assembly.

FIG. 3 shows the arrangement of the valves, cams and actuating levers relative to a cross-plane 29 normal to the center plane 3 and including the cylinder axis 2. Two separate one-armed levers 12 and corresponding cams 11 are positioned between the two rocker levers 13 and the corresponding cams 10 (relative to the cross-plane 29), the one-armed levers 12 being straight while the rocker levers 13 are laterally cranked in addition to the upward bend shown in FIG. 1.

FIG. 3 also shows that the rocker axle 14, which is situated in the cylinder head 1 in the same plane as the camshaft 9, has a cylindrical recess 30 in the area of the cylinder axis 2 to accommodate the injection nozzle 33, including its fastening bracket 31 and fastening screw 32 (cf. FIG. 4), which is guided in a sleeve 35 as it passes through the water jacket 34 of the cylinder head 1. Since the part of the rocker axle 14 between the bearings at the cross-walls 36 of the cylinder head 1 is relatively short, its mechanical strength and rigidity is sufficient, even in the area of the recess 30.

In addition to the arrangement shown in FIG. 3, other configurations of the individual levers are conceivable, depending on the given position of the individual valves and the cams on the camshaft—for instance, they may be differently cranked or inclined. Besides, the necessity, respectively the shape of the recess 30 will depend entirely on the design of the valve mechanism.

For the sake of completeness, reference is made to the cover 39 of the valve housing fastened on a flange 37 at the upper end of the cylinder head 1, with a sealing 38 in between, and to a lubrication bore 40 for lubricating the valve gear, passing through the cylinder head 1 in the area of the bearing pan 15.

The arrangement presented and discussed here is characterized by its particularly compact design of the valve mechanism, permitting a high mechanical rigidity of the valve gear due to the comparatively short levers required, while reducing both outer dimensions and weight of the engine.

We claim:

1. In an internal combustion engine which includes at least one cylinder, each cylinder defining a separate cylinder axis which extends in a common center plane; a crankshaft which defines a crankshaft axis that extends in said common center plane; a cylinder head; at least one pair of intake and exhaust ports which communicate with each cylinder, each intake port and each exhaust port of a pair of intake and exhaust ports being positioned opposite one another relative to said center plane; a movable valve associated with each intake port and each exhaust port; a common crankshaft that is located on one side of said center plane and extends in parallel therewith, said camshaft including at least one cam; a separate one-armed lever which is operated by a cam of said camshaft to move one of the valves associated with each pair of intake and exhaust ports; and a separate rocker lever which is operated by a cam of said camshaft to move a second of the valves associated with each pair of intake and exhaust ports, the improvement wherein said camshaft is positioned above said cylinder head and includes a pair of cams associated with each cylinder, a first cam of each pair of cams contacting and operating an associated one-armed lever and a second cam of each pair of cams contacting and operating an associated rocker lever, each said second cam being axially displaced from each said first cam along said camshaft, wherein each said rocker lever is mounted on an axle which is positioned above said cylinder head the same distance that said camshaft is positioned above said cylinder head, and wherein each said rocker lever has a portion which extends in parallel with said camshaft.

2. An internal combustion engine according to claim 1, including two pairs of intake and exhaust valves associated with each cylinder, and wherein the cams on said camshaft which operate the associated one-armed levers and the cams on said camshaft which operate the associated rocker levers are displaced from each other around the circumference of said camshaft.

3. An internal combustion engine according to claim 1, including two pairs of intake and exhaust valves associated with each cylinder, and wherein the cams on said camshaft which operate the valves located on the same side of said common plane as said camshaft are located between the cams on said camshaft which operate the valves located on the opposite sides of said common plane.

* * * * *